US008670587B2

(12) United States Patent
Townsend

(10) Patent No.: US 8,670,587 B2
(45) Date of Patent: Mar. 11, 2014

(54) AUDIO-BROADCASTING HAT FOR EVENTS

(75) Inventor: Richard W. Townsend, Katonah, NY (US)

(73) Assignee: Entertainment Headwear Inc., Katonah, NY (US)

( * ) Notice: Subject to any disclaimer, the term of this patent is extended or adjusted under 35 U.S.C. 154(b) by 3 days.

(21) Appl. No.: 13/507,503

(22) Filed: Jul. 6, 2012

(65) Prior Publication Data

US 2014/0010401 A1 Jan. 9, 2014

(51) Int. Cl.
*H04R 1/02* (2006.01)
*H04R 5/02* (2006.01)

(52) U.S. Cl.
CPC . *H04R 5/02* (2013.01); *H04R 1/025* (2013.01)
USPC ..... 381/388; 381/386

(58) Field of Classification Search
USPC ..... 381/300, 301, 386, 388; 181/198, 199; 2/171, 195.1, 209.13, 906
See application file for complete search history.

(56) References Cited

U.S. PATENT DOCUMENTS

| | | | | |
|---|---|---|---|---|
| 4,525,878 | A | 7/1985 | Lowe, Jr. | |
| 5,510,961 | A | 4/1996 | Peng | |
| 6,091,829 | A * | 7/2000 | Blackmer et al. | 381/356 |
| 2011/0088142 | A1 * | 4/2011 | Holley | 2/209.13 |
| 2011/0252540 | A1 | 10/2011 | Higgins et al. | |

* cited by examiner

*Primary Examiner* — Tuan D Nguyen
(74) *Attorney, Agent, or Firm* — Richardson & Rosow LLC

(57) ABSTRACT

A hat that allows the wearer to select and play one of a plurality of pre-recorded audio tracks at an event is disclosed. The hat has a visor or brim formed of two layers between which are disposed an electronic audio-playing module having a plurality of pre-recorded audio tracks, a speaker and a plurality of switches. By pressing the appropriate switch, the sound module is activated and plays the selected audio. The provision of multiple tracks allows the wearer to select and broadcast audio appropriate for the event and to play different audios in response to changing circumstances during the event.

6 Claims, 3 Drawing Sheets

AUDIO-BROADCASTING HAT FOR EVENTS

BACKGROUND OF THE INVENTION

It is common for people attending sporting and similar events to wear hats, most usually in the form of a baseball cap, in colors or bearing the insignia associated with the team or players they support or, for example, colleges they attend. Support for the team is provided by the aggregation of the colors of individual hats in a crowd of supporters. Moreover, supporters wearing such hats often cheer the participants, sing college anthems, or yell out their suggested instructions on what the players should be doing in a particular situation, many possibilities of which may occur during an event.

U.S. Pat. No. 4,525,878 discloses a musical hat that will play an audio at the command of a wearer. U.S. Pat. No. 5,510,961 discloses a hat that plays audio and has flashing warning lights. Published United States Patent Application No. 2011/0252540 A1 discloses musical headwear having a pocket into which an electronic audio device can be inserted and removed.

SUMMARY OF THE INVENTION

It is an objective of the present invention to provide headwear that will play and broadcast pre-recorded music, songs, cheers, exhortations, slogans, instructions, and the like, appropriate for an event being attended by the wearer, and for the wearer to select different audio tracks to play depending on the circumstances that may evolve during a game or other event. Thus, the wearer is able to respond in real time as the event happens and to broadcast appropriate audio to be heard by those in the vicinity. If others wearing similar hats play the same audio simultaneously, the sound will be magnified and the support expressed for the participants and the event will be enhanced.

The present invention provides an audio-broadcasting hat having a visor or brim with upper and lower layers between which are disposed an electronic audio-playing module adapted to be connected to an electrical power source and having a plurality of pre-recorded audio tracks, and electrically connected to a speaker and to a plurality of switch means. The audio content on the various tracks of the module is chosen as being associated with or appropriate for a particular event, for example for a particular sport, or for a team or school, and for events that may occur during a game or other event as it progresses. By pressing the appropriate switch through the outer material of the visor the wearer can activate a selected track of audio and broadcast it to be heard by others in the vicinity, offering support, exhortations, instructions, or playing a team or school song. Preferably, the audio components, namely the audio-playing module, the speaker and the switch means are mounted on a substrate, preferably made of a sonically-resonant material, and inserted between the upper and lower layers of the visor or brim. While a hat in the form of a baseball cap is a preferred embodiment, other hats such as a sun-visor or a hat with a brim projecting radially outward around the whole circumference of the hat are also contemplated by the present invention.

DETAILED DESCRIPTION OF THE INVENTION

Figure 1:
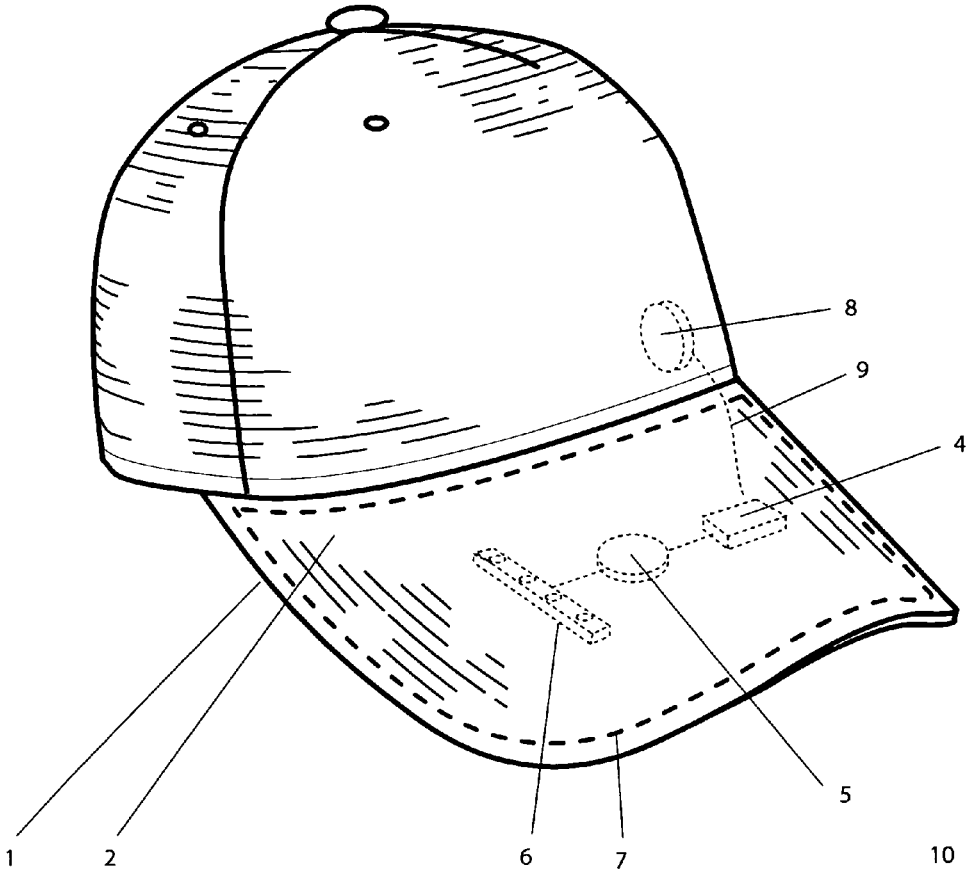
FIG. 1 is a perspective view of a preferred embodiment of the present invention, wherein the dashed lines show the locations of the inserted substrate and the audio components below the upper surface of the visor means depicted.
Figure 2:
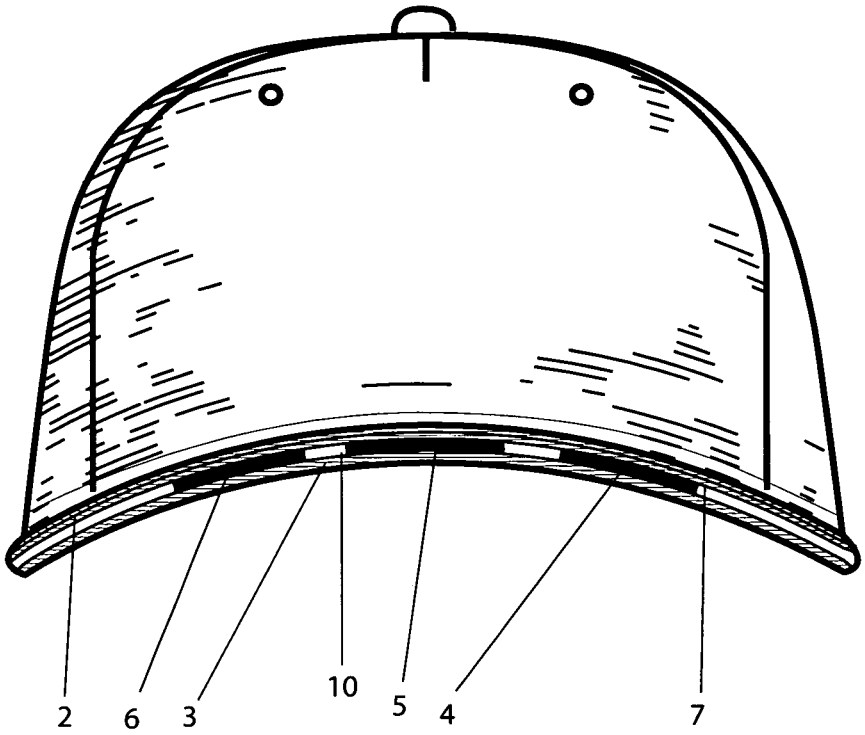
FIG. 2 is a front view of the visor means showing the audio components mounted on the underside of a substrate installed between upper and lower layers of the visor.

The present invention is more fully described by reference to the attached drawings. FIG. 1 shows a perspective view of an audio-broadcasting hat in the form of a baseball cap. The hat has visor means 1, a front view of which is more fully shown in FIG. 2, comprising an upper layer 2 of material and a lower layer 3, which form a compartment 10. The hat and the visor means and the upper and lower layers thereof may be made from conventional materials used for hats generally, such as cotton, wool, synthetic fabrics or blends thereof. In the compartment are located an audio-playing module 4 having a plurality of tracks each having a pre-recorded audio selected to be associated with or appropriate for the event attended, electrically connected to a speaker 5 and to a plurality of switch means 6, which are engageable through one of the layers of the visor means when pressed by the wearer to activate the sound module to play an audio track selected by the wearer appropriate to the event or circumstances occurring during the event. Wiring 9 is provided to connect the audio module to a power source 8.

Figure 3:
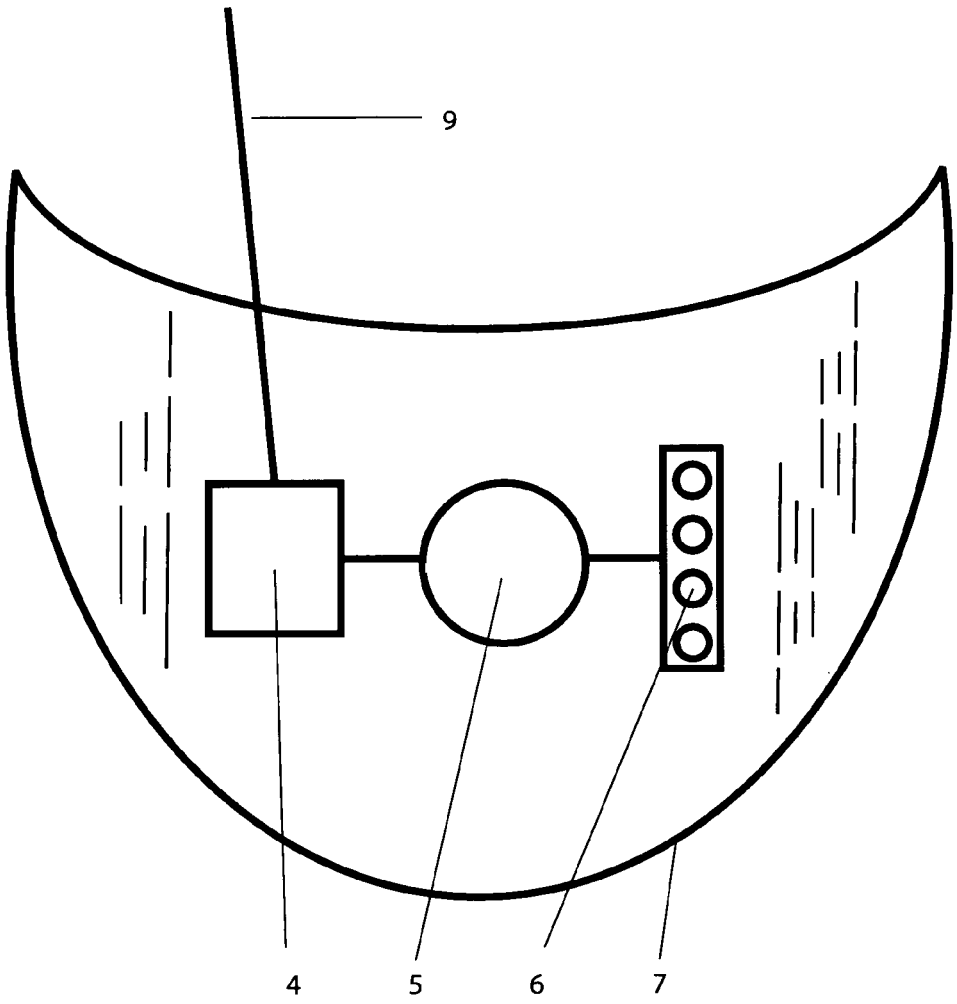
FIG. 3 is a view of the underside of the substrate to be inserted between the upper and lower layers of the visor showing the audio components mounted thereon

While the audio components, namely the audio-playing module, speaker and switch means, can be located and positioned within the compartment formed by layers 2 and 3 by, for example, by gluing or stitching them to the internal surface of one of the layers, preferably the audio components are mounted on a substrate 7 that is shaped to fit in compartment 10 and is desirably sewn to layers 2 and 3, providing shape and some relative stiffness to the visor means. While the inserted substrate may be made of, for example, cardboard or a relatively flexible plastic such as low density polyethylene the substrate is more preferably made from a sonically-resonant hard polymeric material, such as a high density polyalkylene, preferably polypropylene, and is typically from 2 mm. to 2.5 mm. thick. By a sonically-resonant material is meant a material that conducts vibrations emanating from the speaker, thereby amplifying and projecting the audio being broadcast. Desirably, the speaker 5 is tightly and rigidly attached, for example by screws, rivets or a strong adhesive, to the sonically-resonant substrate 7, such that when audio is playing the substrate resonates with the sound from the speaker, thereby enhancing the projection of the audio and the broadcast of the audio to others in the vicinity. The audio sound projection can be further enhanced by making one layer of the visor means, desirably the lower layer 3, from a sonically-transparent material. By "sonically-transparent" is meant a material that does not significantly block or diminish the broadcasting of sound. Such materials include synthetic satins such as a polyester lining material, just heavy enough to be sufficiently opaque to visibly conceal the audio component. The substrate may be formed to provide the desired shape for the visor means, as shown in FIG. 3 for example, where the substrate 7 is formed in a concave shape to provide curvature to the visor means, as is common in one style of baseball hat. In such a hat, the substrate 7 is inserted with the concave surface and the audio components mounted thereon facing the lower layer 3 of the visor means. The audio components are desirably selected to be compact and to provide a low profile so as to fit in the compartment 10 without any significant distortion of the layers 2 and 3. Since the audio components are not visible, a hat according to the present invention has the appearance of a conventional hat and can be worn at any time to protect the wearer's head from the elements or for decorative or fashion purposes.

The power source 8 employed will depend on the audio-playing module employed, but will typically be one or more batteries to provide from 3.5 volts to 5.5 volts to the audio-playing module. The power source may be positioned in any location in the hat, but is conveniently located in a sweatband of the hat, with the battery being selected as a size that will not be too large or uncomfortable to the wearer. If located in this manner, wiring 9 connecting the audio-playing module 4 to the power source 8 runs through the sweatband and into the compartment 10 of the visor means 1. A suitable power source comprises, for example, four CR2032 button cells using silicon diodes to control voltage.

The electronic audio-playing module is a silicon sound chip with electronic amplification on which are digitally pre-recorded a plurality of audio tracks, typically from 2 to 10, preferably 3 to 5, each typically lasting from 2 seconds to 15 seconds, which have been selected as appropriate for a particular event, or for association with a particular team, school or college, or organization. For example, for a hat to be worn at a college football game audio tracks of the college anthem or similar music, shouts of "Go Tigers!", "Touchdown, Touchdown!", "Defense, Defense!", "Push them back, push them back" or similar cheers or exhortations might be pre-recorded. At the game, the wearer can press the switch means associated with a track that matches an occurrence at the game to play that track and then to play other relevant tracks depending on the progress of the game. Analogous audio content can be pre-recorded for other sports or events, such as rallies or ceremonies. The hat incorporating such pre-recorded audio content would typically be in the colors or bear the names, symbols or insignia of the team or college with which the audio is associated. As noted above, the simultaneous playing of an audio track by multiple wearers of hats having the same audio content significantly amplifies the broadcasting of the audio, thereby enhancing the audible support provided to the team or group to which it is directed. If desired, a track on the audio-playing module 4 can be used to provide an "audio prompt", which for the purposes of the present application means an audio track to be played by a wearer which broadcasts instructions or exhortations to others in the adjacent area, for example to coordinate the simultaneous playing of particular audio tracks by others wearing identical or similar hats, or to request or encourage others to make particular oral responses or perform physical actions in support of a team, such as "the wave".

The switch means 6 can be activated through one of the layers 2 and 3 by the wearer touching or pressing on the specific switch means among those provided that operably connects to a particular audio track on the audio-playing module 4, thereby causing it to play. An array of a plurality of switch means 6 can be mounted on a flexible plastic surface, desirably affixed to substrate 7, and positioned in the front or at the side of the visor means 1 between layers 2 and 3, preferably on the side of the substrate 7, sufficiently distanced from the other audio components so as to be readily identified and activated. Preferably, the switch means 6 are mounted to face downward towards the lower layer. The switch means should be of sufficient sensitivity to the touch of a wearer to be actuated easily or, for example, a switch can be actuated by applying pressure between the wearer's thumb and forefinger on the upper and lower layers 2 and 3 in the appropriate location. Suitable switch means include blister buttons or dome switches.

The speaker should be of a size, typically from 30 mm. to 40 mm. so as to fit in the compartment 10 between layers 2 and 3. Suitable speakers include 40 mm. 8 ohm Mylar speakers.

The present invention is not limited to the specific embodiments described above and includes other headwear, such as sun visors, witches hats, Stetsons, Fedoras, and the like, all provided with a plurality of audio tracks associated with or appropriate for a particular event or organization, in accord with the above description. As used herein the term "visor means" includes a visor or bill of a cap-like hat and a brim extending around the full circumference of the headwear.

The invention claimed is:

1. An audio-broadcasting hat for wearing at an event consisting of:

head covering means adapted for wearing on the head of a person and having visor means projecting outwardly therefrom, said visor means having upper and lower layers forming a compartment between said layers; and disposed in said compartment:

(a) an electronic audio-playing module electrically connected to a speaker, said audio-playing module being adapted for connection to an electrical power source, and having a plurality of tracks each having a pre-recorded audio selected to be associated with a pre-chosen event;

(b) a plurality of switch means, each of said switch means being operably connected to a track of said audio-playing module and engageable through one of said layers when pressed by the wearer of said hat, thereby activating the audio-playing module to play an audio track selected by the wearer appropriate to said event;

wherein said audio playing module, speaker and switch-means are mounted on a substrate made of a sonically-resonant material inserted in said compartment and said speaker is rigidly mounted on said substrate such that said substrate resonates when an audio track is played, thereby enhancing the broadcasting of sound from the hat.

2. An audio-broadcasting hat as defined in claim 1 wherein said lower layer of said visor means forming said compartment is a sonically-transparent material.

3. An audio-broadcasting hat as defined in claim 1 wherein at least one of said tracks is an audio prompt.

4. An audio-broadcasting hat as defined in claim 1 in which said visor means projects outwardly from the front of said head covering means to form a cap or sun-visor.

5. An audio-broadcasting hat as defined in claim 1 in which said visor means projects radially from said head covering means.

6. An audio-broadcasting hat for wearing at an event comprising consisting of:

head covering means adapted for wearing on the head of a person and having visor means projecting outwardly from the front of said head covering means, said visor means having an upper layer and a sonically-transparent lower layer forming a compartment between said layers; and disposed in said compartment:

(a) an electronic audio-playing module electrically connected to a speaker mounted on a sonically-resonant substrate, said audio-playing module being adapted for connection to an electrical power source, and having a plurality of tracks each having a pre-recorded audio selected to be associated with a pre-chosen event, said speaker being rigidly mounted to said substrate such that said substrate resonates when an audio track is played, thereby enhancing the broadcasting of sound from the hat;

(b) a plurality of switch means, each of said switch means being operably connected to a track of said audio-playing module and engageable through one of said layers when pressed by the wearer of said hat, thereby activating the audio-playing module to play an audio track selected by the wearer appropriate to said event.

* * * * *